US007152686B2

(12) United States Patent
Howlett et al.

(10) Patent No.: US 7,152,686 B2
(45) Date of Patent: Dec. 26, 2006

(54) DOWNHOLE WEIGHT BEARING APPARATUS AND METHOD

(75) Inventors: Paul David Howlett, Aberdeen (GB); George Telfer, Aberdeen (GB)

(73) Assignee: Specialised Petroleum Services Group Limited, Aberdeen (GB)

( * ) Notice: Subject to any disclaimer, the term of this patent is extended or adjusted under 35 U.S.C. 154(b) by 236 days.

(21) Appl. No.: 10/474,864

(22) PCT Filed: Apr. 4, 2002

(86) PCT No.: PCT/GB02/01607

§ 371 (c)(1),
(2), (4) Date: Mar. 19, 2004

(87) PCT Pub. No.: WO02/081857

PCT Pub. Date: Oct. 17, 2002

(65) Prior Publication Data

US 2004/0154807 A1 Aug. 12, 2004

(30) Foreign Application Priority Data

Apr. 9, 2001 (GB) ..... 0108853.3

(51) Int. Cl.
*E21B 23/04* (2006.01)

(52) U.S. Cl. ..... 166/382; 166/208; 166/212

(58) Field of Classification Search ..... 166/382, 166/208, 120, 212
See application file for complete search history.

(56) References Cited

U.S. PATENT DOCUMENTS

| | | | | |
|---|---|---|---|---|
| 2,765,853 | A * | 10/1956 | Brown | 166/134 |
| 2,880,805 | A * | 4/1959 | Gibbs et al. | 166/120 |
| 3,112,795 | A | 12/1963 | Keithahn | |
| 3,211,227 | A * | 10/1965 | Mott | 166/120 |
| 3,412,799 | A * | 11/1968 | Ellis | 166/120 |
| 3,561,490 | A * | 2/1971 | Little | 138/90 |
| 4,285,402 | A * | 8/1981 | Brieger | 166/311 |
| 5,293,945 | A | 3/1994 | Rosenhauch et al. | |

FOREIGN PATENT DOCUMENTS

DE 945321 7/1956

* cited by examiner

*Primary Examiner*—Kenneth Thompson
(74) *Attorney, Agent, or Firm*—C. Dean Domingue; Robert L. Waddell; Ted M. Anthony

(57) ABSTRACT

A downhole tool for connection in a work string to prevent premature activation of weight set tools on the work string. The tool has moveable pads which contact the tubing wall and thereby support the weight of the work string. The pads are activated by increasing fluid pressure in the annulus between the tool and tubing wall and deactivated by increasing fluid pressure through the central bore of the tool.

13 Claims, 1 Drawing Sheet

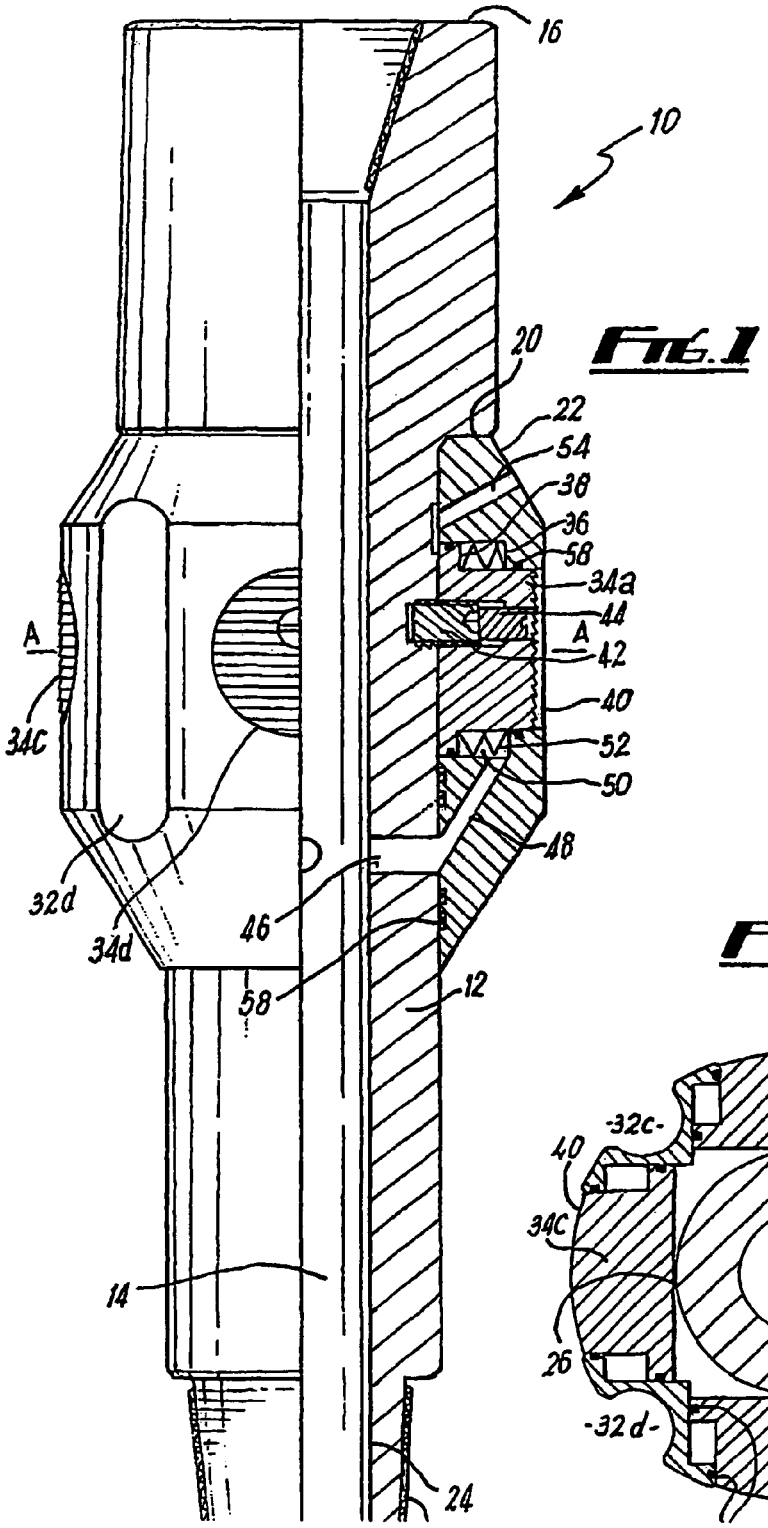
FIG. 1
FIG. 2
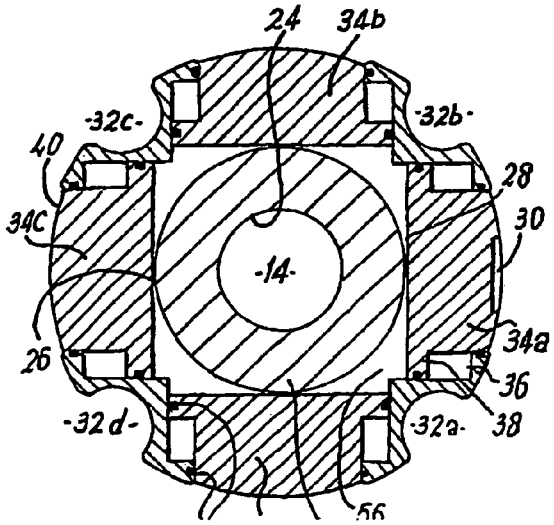

DOWNHOLE WEIGHT BEARING APPARATUS AND METHOD

CROSS-REFERENCE TO RELATED APPLICATIONS

This patent application claims an international filing date of 4 Apr. 2002 and a priority date of 9 Apr. 2001.

STATEMENT REGARDING FEDERALLY SPONSORED RESEARCH

Not applicable.

BACKGROUND OF THE INVENTION

The present invention relates to downhole tools and, in particular, though not exclusively, to a tool which supports the weight of a work string within a well bore, as typically utilised in oil and gas production.

During drilling or completion of a well, a work string comprising connected sections of tubing is typically inserted in the well bore. Each additional section increases the weight exerted on the string. This weight is required for some downhole operations such as drilling where the weight ensures a drill bit, mounted on the end of the work string, is held against a formation.

Additionally weight set tools have been developed which generally operate by landing a part of the tool on a shoulder of the tool or a formation within the well bore. The contact surface then allows the tool to bear the weight of the string, and in bearing the weight of the string, parts within the tool are moved in relation to each other to perform a function required by the tool.

Such a weight set tool, for example, is that in UK Patent No 2272923 which describes a downhole tool for circulating fluid. This tool includes a sleeve which engages a shoulder portion in the well bore. When engagement occurs, the weight of the string bears down on the tool, moving the tool in relation to the sleeve which is now static against the formation. The change in relationship between the tool and the sleeve aligns ports between a bore of the tool and the sleeve to provide for the radial passage of fluid from the bore of the tool.

A disadvantage of such weight set tools are that they can be activated prematurely whenever an apparent weight or, alternatively, contact with a formation in the well bore occurs. These conditions generally prevail when the body of the tool experiences a pressure differential across its surface, causing the body to expand longitudinally. A temperature differential across the body may have the same effect, as can changes in the body dimensions caused by changes resulting from different plugs of fluids passing down the bore of the tool and up the annulus between the string and the well bore wall or tubing wall if inserted.

It is an object of at least one embodiment of the present invention to provide a downhole tool which prevents the premature activation of weight set tools mounted on a string below the device.

It is a further object of at least one embodiment of the present invention to provide a downhole tool which can be selectively actuated to support at least part of the weight of a string to which it is attached.

BRIEF SUMMARY OF THE INVENTION

According to a first aspect of the present invention, there is provided a downhole tool for connection in a string to be inserted into tubing in a well bore, the tool comprising a tubular body including means for attachment to the string, and a sleeve mounted on the tubular body wherein the sleeve includes means to contact a wall of the tubing, such that the tool bears at least a part of a weight of the string.

Preferably the means for attaching the tubular body to the string are threaded box sections.

Preferably the means to contact the tubing wall is a plurality of moveable pads. Preferably there are four pads. Preferably the pads are arranged to move radially with respect to the longitudinal axis of the bore.

Preferably the tubular body has inner and outer surfaces which are substantially cylindrical. More preferably the tubular body includes one or more radial ports. Advantageously, the tubular body includes one radial port for each moveable pad.

Preferably the sleeve has a substantially cylindrical outer surface. Preferably also the sleeve has a square cross-sectional inner surface, which is a clearance fit over the tubular body. Advantageously, the sleeve includes one or more grooves positioned longitudinally on the outer surface. Each groove allows for the passage of fluids between the outer surface of the sleeve and the inner surface of the tubing wall.

Additionally, the sleeve may include tapered upper and lower sections on the outer surface to direct fluid flow across the sleeve.

Preferably the pads include an abrasive outer surface. The abrasive outer surface provides a large surface area with which to contact the tubing wall. The abrasive surface also provides a better grip to the tubing wall, thereby ensure the sleeve is held while bearing the weight of the string.

Preferably the tool is hydraulically operated. Thus the moveable pads can be selectively actuated to contact the wall of the tubing. More preferably the sleeve includes a at least one port, the port(s) providing access of fluid from the annulus between the tool and the tubing wall to a back surface of the pad.

Preferably also there is at least one second port in the sleeve, the second port(s) providing access of fluid between the radial port of the tubular body and a front surface of the moveable pad, such that fluid travelling through the bore can actuate the front surface of the pad to move the pad away from the tubing wall and disengage the tool.

Preferably also the tool includes means to locate the pads against the tubular body. The means to locate the pads may comprise a pin. More preferably the pin is a grub screw. Preferably also the pin includes a cover plug. Advantageously, the means for locating the pad against the tubular body is located eccentrically or 'off centre' to the pad, so that the pad does not spin when being moved.

According to a second aspect of the present invention, there is provided a method of supporting a string within tubing in a well bore, the method comprising the steps of:

mounting a downhole tool, according to the first aspect, onto the string;

running the string into the tubing; and increasing fluid pressure in an annulus between the string and the tubing wall, such that the fluid pressure causes moveable pads on the downhole tool to contact the tubing wall, and thereby anchor the tool to the tubing wall.

Preferably also the method may include the step of increasing the fluid pressure in the bore of the downhole tool, such that an increased fluid pressure enters the sleeve through the second outlet, and disengages the moveable pads from the tubing wall.

Thus activation and deactivation of the tool can be controlled via the differential pressure between the annulus and the central bore of the tool.

BRIEF DESCRIPTION OF THE DRAWINGS

An example embodiment of the present invention will now be illustrated with reference to the following Figures, in which:

FIG. 1 is a downhole tool in accordance with a first embodiment of the present invention; and FIG. 2 is a cross-sectional view of the downhole tool of FIG. 1 taken through the Section A—A.

DETAILED DESCRIPTION OF THE INVENTION

Reference is first made to FIG. 1 of the drawings which depicts a downhole tool generally indicated by reference numeral 10. The downhole tool 10 has a tubular body 12, which includes a bore 14 passing longitudinally therethrough. At one end of the tool 10 is a threaded box section 16 to connect the tool to adjacent sections of a string (not shown). A complimentary threaded pin 18 is located at the opposite end of the tool 10. The threaded pin 18 provides for connection of the tool 10 to adjacent sections of the string below the tool 10. Located against a shoulder 20 of the tool 10 is a sleeve 22. The arrangement of the sleeve 22 on the body 12 of the tool 10 is more clearly shown in FIG. 2. FIG. 2 being a section A—A through the tool 10 of FIG. 1.

In FIG. 2 the tubular body 12 has an inner cylindrical surface 24 containing the throughbore 14 and an outer cylindrical surface 26. The outer cylindrical surface 26 is a clearance fit onto the inner substantially square cross-sectional area of the inner surface 28 of the sleeve 22. The outer surface 30 of the sleeve 22 is substantially circular, but includes four indents or grooves 32A–D. The grooves 32A–D ensure that fluid can flow past the tool 10 at all times. Mounted on the sleeve 22 are four moveable pads 34A–D. Each pad 34A–D can move radially away from the body 12 to a point at which overhangs 36 on the sleeve and 38 on the pad connect. It will be appreciated that although only indicated at one overhang, the overhangs 36, 38 exist around each of the moveable pads. This is clearly evident in FIG. 1, where the pads are seen to be circular. The outer surface 40 of each pad is an abrasive surface to provide better contact to the wall of the tubing (not shown).

To prevent the circular pads 34A–D from spinning, they are both held by the overhangs 36, 38 and located on an offset grub screw 42 and a cover plug 44. Each grub screw 42 is attached to the body 12 and the pads 34A–D can slide along the outer edge of the grub screw 42 and cover plug 44. To assist in this the cover plug 44 is made of PTFE.

Within the tubular body are four radial ports 46 which provide fluid contact to the sleeve 22. Where each radial port 46 meets the sleeve 22 there is a passage 48 on the sleeve 22 which allows fluid to travel to a chamber 50 located between the overhangs 36, 38. Within the chamber 50 is located a spring 52 which preferentially holds the moveable pad 34 away from the tubing wall, and against the body 12.

At the top of the sleeve 22 is a further passage 54 which provides an inlet of fluid from the annulus between the tool 10 and the tubing into a chamber 56. Chamber 56 is created in the space between the outer surface 26 of the body 12 and the inner surface 28 of the sleeve 22.

To prevent the ingress of fluid between the sleeve 22 and the body 12 o-rings 58 are positioned on either side of each of the chambers 50, 56.

In use, the tool is connected on a string via the box section 16 and pin section 18. The string is run into the tubing, within a wellbore. It will be appreciated, however, that the term 'tubing' encompasses the common components of casing, liner and the like.

At a required location, fluid can be pumped through the bore 14 of the tool 10. While the fluid pressure in the bore 14 is higher than that in the annulus passing the grooves 32 of the sleeve 22, the pads remain closed against the body 12. Thus, the outer surface 26 of the body 12 contacts the inner surface 28 of the sleeve 22. This is achieved through the passage of fluid through the radial port 46, the passage 48 and into the chamber 50, and assisted by the action of spring 52.

However, if the fluid pressure in the annulus increases to a point to be greater than the fluid pressure within the bore 14, fluid will enter the passage 54 in the sleeve 22 and fill the chamber 56. Due to the comparatively large surface area of the inner surface 28 of the sleeve 22, the pads 34 will move rapidly outwards from the body 12. The outer surface 30 of the pads will contact with the tubing wall and provide a grip which will anchor the tool 10 against the tubing wall. In this position, the tool will bear the weight of the string above the point at which it is attached.

To disengage the tool 10, the fluid pressure in the bore 14 is increased to a level greater than the fluid pressure in the annulus. When this occurs, the fluid will enter the radial port 46, travel through the passage 48 into chamber 50 and separate the overhangs 36, 38, moving the pad back against the body 12, to contact the outer surface of the body 26 with the inner surface 28 of the sleeve 22.

The principal advantage of the present invention is that the tool of the invention can be mounted on a string and run downhole without having any effect on other tools mounted on the same string. When required, the tool is hydraulically operated and once operated, the tool can hold up the weight of the string and prevent any weight being applied to any tools located on the string below the position of the weight bearing tool.

A further advantage of the present invention is that the tool may be engaged or disengaged any number of times within the well bore and does not have to be returned to the surface to be reset or reconfigured.

It will be apparent to those skilled in the art that various modifications may be made to the invention herein described, without departing from the scope thereof. For example, the number of pads may be increased, their shape or the size of the chambers or reservoirs around them may be changed. Similarly, the tool may be operated by decreasing fluid pressure in the annulus and/or central bore.

The invention claimed is:

1. A downhole tool for connection in a work string to be inserted into tubing in a well bore, the tool comprising a tubular body and a sleeve mounted on the tubular body; the body having a central bore therethrough, means for attachment to the work string and at least one radial port; the sleeve including a plurality of moveable pads, and at least one first port and at least one second port, wherein the first port(s) provides access of fluid from the annulus between the tool and the tubing wall to a back surface of the/each pad so that the/each pad is moveable to contact a wall of the tubing such that the tool bears at least a part of a weight of the work string and, the second port(s) provides access of fluid between the radial port(s) of the body and a front surface of the/each pad, so that the tool can be controlled via differential pressure between the annulus and the central bore of the work string.

2. A downhole tool as claimed in claim 1 wherein the pads are arranged to move radially with respect to the longitudinal axis of the bore.

3. A downhole tool as claimed in claim 1 wherein the tubular body includes one or more radial ports for each moveable pad.

4. A downhole tool as claimed in claim 1 wherein the sleeve has a substantially cylindrical outer surface and a substantially square cross-sectional inner surface.

5. A downhole tool as claimed in claim 4 wherein the sleeve includes one or more grooves positioned longitudinally on the outer surface.

6. A downhole tool as claimed in claim 1 wherein the pads include an abrasive outer surface.

7. A downhole tool as claimed in claim 1 wherein the moveable pads can be selectively actuated to contact the wall of the tubing.

8. A downhole tool as claimed in claim 1 wherein the tool includes means to locate the pads in relation to the tubular body.

9. A downhole tool as claimed in claim 8 wherein the means to locate the pads comprises one or more pins there being a respective pin for each pad.

10. A downhole tool as claimed in claim 8 wherein each pad is located in a circular cross-section aperture in the sleeve, and wherein the means for locating each pad against the tubular body is located eccentrically relative to the respective aperture.

11. A method of supporting a work string within tubing in a well bore, the method comprising the steps of:

mounting a downhole tool in the work string, the downhole tool comprising a tubular body and a sleeve mounted on the tubular body, the sleeve including a plurality of moveable pads;

exposing a back surface of each moveable pad to fluid in an annulus defined between the work string and a wall of the tubing through an at least one first port in the sleeve;

exposing a front surface of each moveable pad to fluid in the work string through an at least one radial port in the tubular body and an at least one second port in the sleeve;

running the work string into the tubing;

increasing fluid pressure in the annulus relative to fluid pressure in the work string, such that the fluid pressure acts on the back surface of each moveable pad to the moveable pads to contact the tubing wall, and thereby anchor the tool to the tubing wall; and increasing the fluid pressure in the work string relative to the fluid pressure in the annulus, such that the fluid pressure acts on the front surface of each moveable pad, to cause the moveable pads to disengage from the tubing wall.

12. A downhole tool for connection in a work string to be inserted into tubing in a well bore, the tool comprising a tubular body including means for attachment to the work string, and a sleeve mounted on the tubular body wherein the sleeve includes a plurality of moveable pads to contact a wall of the tubing and at least one port, the port(s) providing access of fluid from the annulus between the tool and the tubing wall to a back surface of the/each pad, such that the tool bears at least a part of a weight of the work string, and wherein the sleeve has a substantially cylindrical outer surface, a substantially square cross-sectional inner surface and one or more grooves positioned longitudinally on an outer surface thereof.

13. A method of supporting a work string within tubing in a well bore, the method comprising the steps of:

mounting a downhole tool in the work string, the downhole tool comprising a tubular body and a sleeve mounted on the tubular body, the sleeve having a substantially cylindrical outer surface, a substantially square cross-section inner surface and a plurality of moveable pads;

running the work string into the tubing;

increasing fluid pressure in an annulus between the work string and the tubing wall, such that the fluid pressure causes the moveable pads to contact the tubing wall, and thereby anchor the tool to the tubing wall; and permitting fluid flow along the well bore past the downhole tool along one or more grooves positioned longitudinally in an outer surface of the sleeve.

* * * * *